US005538172A

United States Patent [19]

Jochum et al.

[11] Patent Number: 5,538,172

[45] Date of Patent: Jul. 23, 1996

[54] EXPLOSIVE POWDER CHARGE OPERATED SETTING TOOL

[75] Inventors: Peter Jochum, Meiningen, Austria; Markus Frommelt, Schaan, Liechtenstein

[73] Assignee: Hilti Aktiengesellschaft, Schaan, Liechtenstein

[21] Appl. No.: 231,604

[22] Filed: Apr. 22, 1994

[30] Foreign Application Priority Data

Apr. 24, 1993 [DE] Germany ..... 43 13 504.8

[51] Int. Cl.[6] ..... B25C 1/14

[52] U.S. Cl. ..... 227/10; 227/130; 173/212; 60/638

[58] Field of Search ..... 227/9, 10, 11, 227/130; 173/210, 212; 60/638

[56] References Cited

U.S. PATENT DOCUMENTS

| | | | |
|---|---|---|---|
| 3,744,240 | 7/1973 | Henning et al. | 60/638 X |
| 4,056,935 | 11/1977 | Gassmann | 227/10 X |
| 4,196,834 | 4/1980 | Beton | 227/10 |
| 4,595,134 | 6/1986 | Jochum | 227/10 X |
| 4,711,385 | 12/1987 | Jochum | 227/10 |

*Primary Examiner*—Rinaldi I. Rada
*Assistant Examiner*—Jay A. Stelacone
*Attorney, Agent, or Firm*—Anderson Kill Olick & Oshinsky

[57] ABSTRACT

An explosive powder charge operated setting tool contains a channel (7) located between an inner piston guide (2) for a piston (1) and an outer housing part (6). At the rear end of the tool, the channel (7) continues in a carrier (3) and can be in communication with a cartridge receptacle (4) in the carrier (3). In its front region, the channel (7) is connected via a first opening (2*c*) in the piston guide (2) with a guide bore (2*a*) for the piston (1). Towards the rear end of the channel (7) there is a valve arrangement for forming a propellant gas storage space connected through the first opening (2*c*) to the guide bore (2*a*). Propellant gases within the storage space are compressed by the piston (1) driven in the setting direction and, after completion of the driving or setting procedure, serve to return the piston (1) back into its rear starting position by expansion of the storage space gases. After the driving operation, a second opening (3*a*) communicating with the ambient atmosphere vents the space rearwardly of the piston (1) so that the piston (1) can move without interference back into the rear starting position and, in addition, any residual gases can escape through the second opening into the ambient atmosphere.

6 Claims, 3 Drawing Sheets

EXPLOSIVE POWDER CHARGE OPERATED SETTING TOOL

BACKGROUND OF THE INVENTION

The present invention is directed to an explosive powder charge operated setting tool with a piston guide for a piston which can be driven from a rear starting position into a front end position by propellant gases generated when an explosive powder charge is ignited. A carrier including a cartridge receptacle is located at a rear end of the piston guide and a housing part laterally encloses and is spaced radially outwardly from the piston guide. A channel is located between the piston guide and the housing part and discharges through an opening in the front end of the piston guide into a guide bore for the piston.

In explosive powder charge operated setting tools of the above type, a piston is driven by propellant gases from an ignited explosive powder charge and the piston is propelled from a rear starting position into a front end position. Prior to ignition, the explosive powder charge is fed into a cartridge receptacle. Before reaching the front end position, the piston impacts on a bolt, nail or similar fastening element, and drives the element into a hard receiving material, such as concrete, metal and the like.

To position the piston for another driving step after it has been driven forwardly and the driving step has terminated, it must be returned from its front end position into its rear starting position. Mechanical arrangements are known for effecting the return travel of the piston. Such mechanical arrangements include pushing the piston rearwardly by a separate tappet or ram or displacing the piston guide relative to the piston in the driving direction and subsequently returning the piston guide along with the piston to the starting position. In all of these procedures, the piston reaches the rear starting position, however, these various mechanical arrangements for returning the piston involve the disadvantage of a considerable handling effort. This handling results in a loss of time which is particularly disadvantageous in rapid series driving of the fastening elements. Further, mechanically operated return devices are relatively malfunction-prone, particularly as a result of fouling caused by the propellant gases.

In place of mechanically operated return procedures, a return of the piston by the use of propellant gases is known, for instance in U.S. Pat. No. 3,744,240. In such a procedure it is known to enclose the piston guide serving to guide the piston spaced radially inward in the housing part. A carrier with a cartridge receptacle is located at the rear end of the piston guide. A channel connected to the cartridge receptacle is located between the housing part and the piston guide and conducts propellant gases in the setting direction and then through the opening in the piston guide into the guide bore for the piston.

In this known tool, the propellant gases act only in directly, that is, via an insertion piece, on the piston after the explosive powder charge has been ignited. The insertion piece forms a closure for the channel during the ignition of the powder charge. After the channel has been opened by the insertion piece, the propellant gases flow into the guide bore in front of the piston, where they are compressed and subsequently, as they expand, drive the piston back into the rear starting position. In this arrangement, the insertion piece must also be driven back into its rear starting position, whereby the channel is being closed in preparation for the next driving step. In this procedure there is the problem that the spaces must be adequately vented to enable the piston and the insertion piece to return to their rear starting position. This is possible only by disposing venting openings where even if slight contamination or clogging occurs adequate venting is no longer ensured and the entire operation of the return procedure is questionable. Thus the tool is not only very expensive in construction, but it also malfunction-prone and requires considerable maintenance and cleaning operations.

SUMMARY OF THE INVENTION

The primary object of the present invention is to provide an explosive powder charge operated setting tool in which a piston return is effected by propellant gases where the tool has a simple construction and is not prone to malfunction by eliminating parts which tend to become fouled.

In accordance with the present invention the carrier in the setting tool has a closable passage for selectively connecting the channel to the ambient atmosphere and, in addition, a closable valve arrangement is provided in the channel for forming a storage space closed to the atmosphere and open at the front end region of the channel to the guide bore in the piston guide.

In the piston return procedure of the present invention, when the powder charge is ignited, the channel is still closed to the atmosphere, however, immediately after the piston starts to move in the setting direction the channel is connected to the guide bore. As a result, the propellant gases, after they have set the piston in motion, flow through the channel into the front end region of the guide bore. As soon as the channel and the guide bore have been filled with propellant gases, the valve arrangement is closed, whereby a common storage space is formed closed to the ambient atmosphere. The propellant gases are compressed in this storage space as the piston is driven towards its front end position. When the driving operation is completed, the compressed propellant gases expand and the piston is driven back to its rear starting position. In the meantime, that is after the valve arrangement is closed, the region to the rear of the valve arrangement is opened to the atmosphere through the passage in the carrier afforded by the invention. Accordingly, all the residual portions of the propellant gases are expelled so that no fouling or contamination can be deposited in the tool due to unburned components of the propellant powder charge. Further, there is a complete venting of the rearward region of the guide bore due to the connection to the atmosphere, whereby the piston can be returned without any resistance to its rear starting position.

The effective return of the piston using the propellant gases is achieved by the two features afforded by the invention. Due to the connection of the channel with the ambient atmosphere an adequate venting occurs, whereby residual components of the propellant gases can escape while the piston can be driven into its rear starting position by avoiding the development of any gas cushion.

The carrier and the piston guide are relatively displaceable with respect to one another in a preferred manner. This yields a large advantage in that the valve arrangement can be closed expeditiously by relative axial displacement of the carrier with respect to the piston guide opposite to the setting direction. Since the cartridge receptacle is located in the carrier, the relative displacement proceeds by itself, that is, by the action of the propellant gases, which act equally on all sides and thus, apart from the action on the piston in the setting direction, act on the carrier opposite to the setting direction driving it counter to the setting direction. Preferably, the valve arrangement is effected by a cross-sectional constriction within the channel afforded by a suitable configuration of the carrier and of the piston guide. In the valve arrangement the closure part is effectively formed by the piston guide which, after a relative displacement with the carrier, closes off the channel.

A relative displacement between the carrier and piston guide is also used for opening a passageway in the carrier affording a connection to the ambient atmosphere. This passageway is preferably closable by relative axial displacement of the carrier with respect to the piston guide in the setting direction. With a suitable arrangement of the passageway or opening, it can be assured in a simple manner that the channel considered timewise is then only connected to the atmosphere, if the valve arrangement is closed whereby the closed storage space essential for the invention is created.

Since the passageway or opening is easily provided in the carrier, the passageway is openable in such a way that the piston guide forms a closure part. In this arrangement it is not necessary to take any special measures with respect to the piston guide, rather it is sufficient if an appropriate region of the piston guide blocks the passageway.

To assure at the instant of ignition of the propellant powder charge that the propellant gases generated build up adequate pressure for accelerating the piston, the channel to the cartridge receptacle is closed by the piston located in the rear starting position. This feature is effected in a preferred manner whereby the piston in its rear starting position has moved rearwardly over the connection between the channel and the cartridge receptacle and when the piston starts to move in the setting direction it opens the connection. A simple arrangement of the setting tool in the present invention can be achieved if the carrier and housing part are connected to form a unit axially displaceable relative to the piston guide. Such a connection is not particularly intended to be a single part, since for other reasons an uncoupling of the two parts can be advantageous.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DETAILED DESCRIPTION OF THE INVENTION

Figure 1:
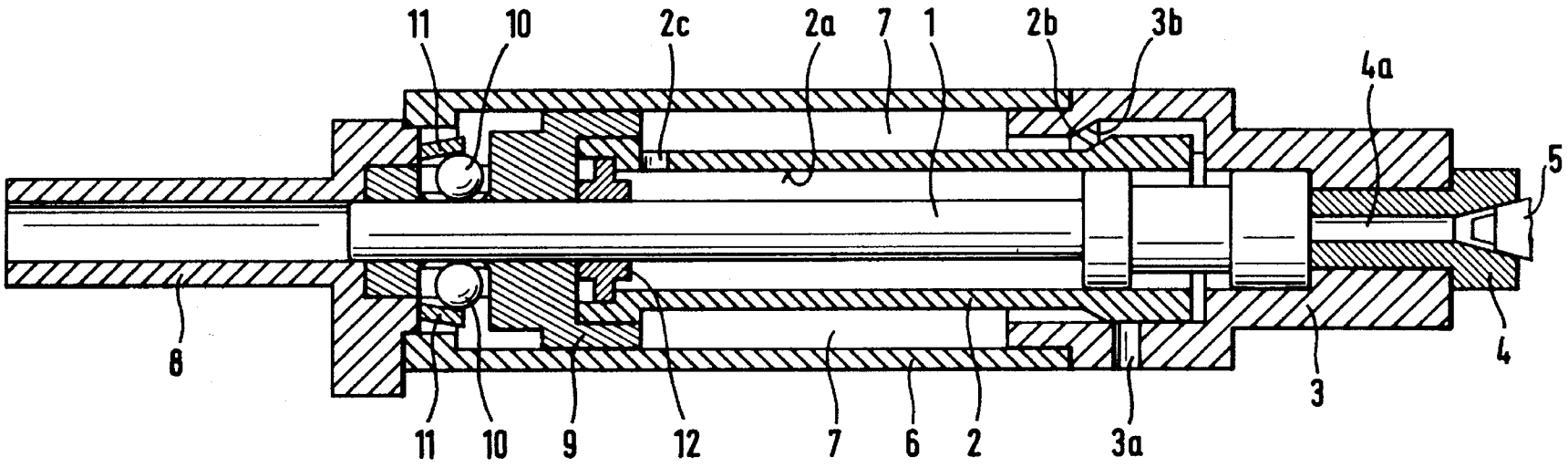
FIG. 1 is an axially extending view of certain parts forming an explosive powder charge operated setting tool with the piston in the rear starting position and illustrating the parts essential for the invention.
Figure 2:
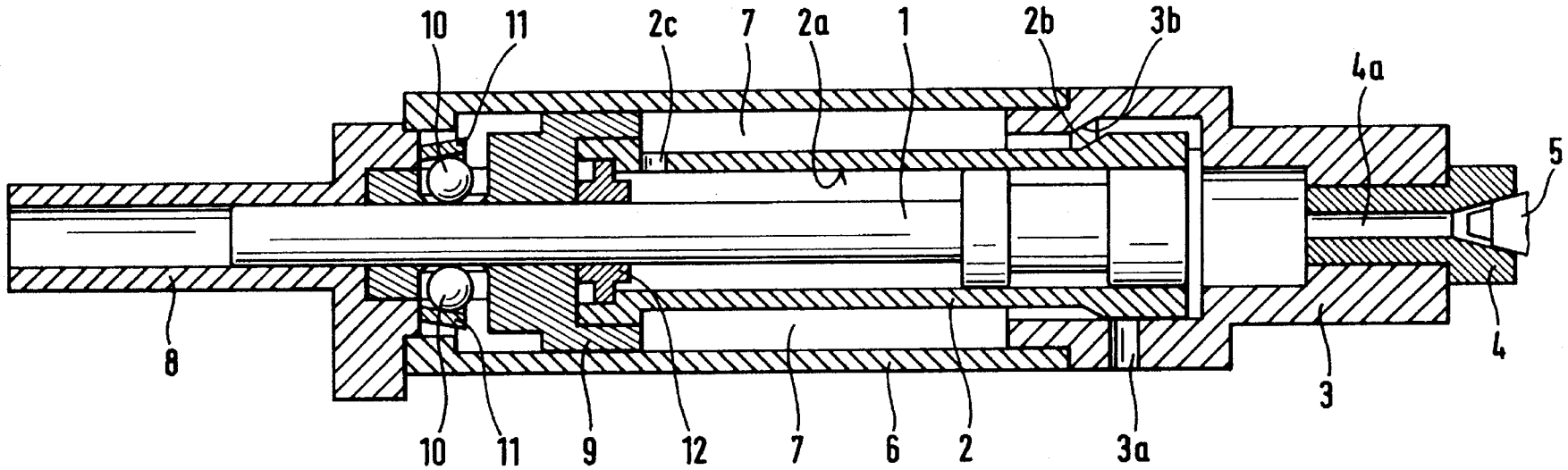
FIG. 2 is an axially extending sectional view similar to FIG. 1, however, with the piston moving towards the front end position.
Figure 3:
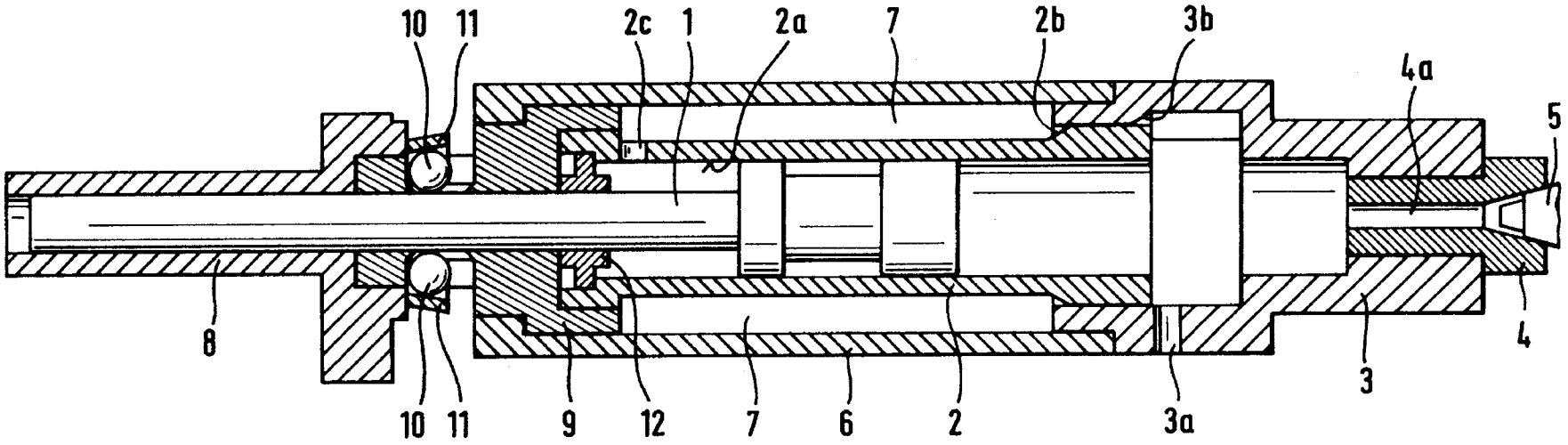
FIG. 3 is an axially extending sectional view similar to FIG. 1 but with the piston in its front end position.

In FIGS. 1 to 3 the parts of the explosive powder charge operated setting tool are illustrated in different operating positions. Independent of the operating positions, the tool includes the following parts.

As viewed in the three figures, the front end of the tool and of its various parts is located to the left and the rear end is located to the right. An axially elongated piston 1 is axially displaceably supported in an axially extending tubular piston guide 2. The rear end region of the piston guide 2 is enclosed by a carrier 3 which extends rearwardly from the piston guide. The carrier 3 contains a cartridge receptacle 4 forming a bore 4*a* through which propellant gases, generated on ignition of an explosive powder charge 5, flow into a guide bore 2*a* in the piston guide.

Piston guide 2 is laterally enclosed by a housing part 6 spaced radially outwardly from the piston guide. The rear end of the housing part 6 is connected with the carrier 3. An axially extending channel 7 is located between the housing part 6 and the piston guide 2 and the channel can be connected with the cartridge receptacle 4, as it is shown in FIG. 2. A first opening 2*c* is located in the front end region of the piston guide 2 for communicating the channel 7 with the guide bore 2*a* in the piston guide.

A multipart guiding device is connected to the front end of the piston guide 2. This guiding device is made up essentially of a guide element 8 extending forwardly of the front end of the housing 6, and a guide bushing 9 located within the housing 6 at the front end of the piston guide 2. The guide element 8 holds and guides the fastening element to be driven. Guide bushing 9 supports a braking device for the piston 1 and the braking device includes balls or spheres 10 in a flexible cage 11. Immediately rearwardly of the bushing 9 is a damping element 12.

The operation of the return movement of the piston 1 is as follows with reference to the individual figures.

In FIG. 1, the piston 1 is located in the rear starting position. In this starting position, the front end of the setting tool is placed against the receiving material, not shown, into which a fastening element is to be driven, also not shown. The fastening element is supported within the guide element 8. FIG. 1 shows how channel 7 is closed off by the piston 1 relative to the cartridge receptacle 4. In this position, the valve arrangement toward the rear region of the channel is open and this valve consists of a widened outside diameter surface 2*b* on the piston guide and a constriction surface 3*b* on the carrier 3. Further, a second opening or passageway 3*a* extends transversely of the axial direction and is closed by the surface of the piston guide 2. Second opening 3*a* is open to the exterior of the tool, however, in the closed position the channel 7 is not in communication with the ambient atmosphere.

After the propellant or explosive powder charge 5 is ignited, the generated propellant gases flow through the bore 4*a* in the cartridge receptacle 4 from the cartridge chamber and drive the piston from its rear starting position to its front end position, as shown in FIG. 2. At this stage the channel 7 is in communication with the cartridge receptacle 4 so that a portion of the propellant gases pass through the channel 7 and the first opening 2*c* into the guide bore 2*a*. The second opening 3*a* remains closed by the piston guide, so that the channel 7 is not in communication with the ambient atmosphere.

Since the propellant gases expand equally in all directions, the carrier 3 is displaced counter to the setting direction or the piston driving direction, that is, opposite to the force applied on the piston 1. Due to the mass relationship, the displacement of the carrier 3 is somewhat delayed timewise, that is, the displacement takes place only when the piston 1 has arrived in the front end position shown in FIG. 3. In the position displayed in FIG. 3, the valve arrangement formed by the widened outer surface 2*b* of the piston guide 2 and the constriction 3*b* of the carrier is closed. Due to the relative axial displacement between the carrier 3 and the piston guide 2, the second opening or passageway 3*a* is opened by the piston guide establishing communication between the ambient atmosphere and the interior of the carrier. Due to this communication with the atmosphere, residual and possibly unburned portions or components of the propellant charge 5 can escape through the second opening 3*a* into the ambient atmosphere and thus do not cause any contamination or fouling of the tool. The forward regions of the channel 7 and of the guide bore 2, due to the closed valve arrangement, form a storage space closed to the ambient atmosphere in which the propellant gases are compressed by the forward movement of the piston 1. When the piston 1 reaches the front end position, the compressed propellant gases expand and drive the piston opposite to the setting direction back into the rear starting position, and the space rearward of the piston within the piston guide 2 and the carrier 3 is vented through the second opening 3*a* to the ambient atmosphere. Accordingly, from the position shown in FIG. 3, the position of the essential parts shown in FIG. 1 is reached, so that another driving operation can be effected after a new cartridge or powder charge 5 is placed in the cartridge receptacle 4.

Accordingly, as shown in FIGS. 1 to 3, the relative displacement of the carrier 3 along with the connected housing part 6 occurs with respect to the piston guide 2 and with the associated guidance arrangement made up of the guide element 8 and guide bushing 9. The braking device formed by the balls 10 and the flexible cage 11 effect a braking action on the piston 1 during the driving operation and release the piston when it is driven back into the rear starting position by the expansion of the compressed propellant gases. When the balls 10 are driven into the flexible cage 11 during the driving operation, braking is achieved with increased friction acting on the piston 1. This friction is released when the piston moves opposite to the setting direction, with the balls being released from the flexible cage 11. If the piston is driven when the setting tool is not in contact with a receiving material, the damping element acts to intercept the piston for avoiding any overloads on the tool parts which would tend to destroy them.

While a specific embodiment of the invention has been shown and described in detail to illustrate the inventive principles, it will be understood that the invention may be embodied otherwise without departing from said principles.

We claim:

1. An explosive powder charge operated setting tool comprises an axially extending tubular piston guide (2) having a front end and a rear end spaced axially apart, said piston guide (2) forming an axially extending guide bore (2*a*), an axially extending piston (1) is mounted in said guide bore (2*a*) and is axially displaceable therein between a rear starting position adjacent the rear end of the piston guide (2) and a front end position spaced axially from the rear end toward the front end of said piston guide (2), said piston has a setting direction extending in the axial direction of said piston from the rear end towards the front end of said piston guide, a carrier (3) is located at the rear end of said piston guide and extends in the axial direction rearwardly from the rear end of said piston guide (2), a housing part (6) laterally encloses and is spaced radially outwardly from said piston guide (2), a cartridge receptacle (4) is located within said carrier (3) in line with said guide bore (2*a*), a cartridge chamber (5) is located within said cartridge receptacle (4), an axially extending channel (7) is located between piston guide (2) and said housing part (6) and is arranged to selectively communicate said cartridge receptacle (4) and a first opening (2*c*) in a front end region of said piston guide (2), wherein the improvement comprises that said carrier laterally encloses an axially extending rear end region of said piston guide in the rear starting position, a closable second opening (3*a*) in an axially extending region of said carrier (3) laterally enclosing said piston guide in the rear starting position for selectively communicating said channel (7) to the ambient atmosphere in the front end position, a closable valve arrangement (2*b*, 3*b*) for said channel (7) for forming a storage space in said channel (7) closed to the ambient atmosphere and in communication through said first opening (2*c*) with said guide bore (2*a*), and said valve arrangement (2*b*, 3*b*) being closable by relative axial displacement of said carrier (3) opposite to the setting direction with respect to said piston guide (2).

2. Setting tool, as set forth in claim 1, wherein said piston guide forms a closure part of said valve arrangement (2*b*, 3*b*).

3. Setting tool, as set forth in claim 1 or 2, wherein said second opening (3*a*) is closable in the setting direction by relative axial displacement of said carrier (3) with respect to said piston guide (2).

4. Setting tool, as set forth in claim 3, wherein said carrier (3) forms a closure part of said valve arrangement (2*b*, 3*b*).

5. Setting tool, as set forth in claim 1 or 2, wherein said channel (7) is disposed out of communication with said cartridge receptacle (4) when said piston (1) is located in the rear starting position.

6. Setting tool, as set forth in claim 1 or 2, wherein said carrier (3) and said housing part (6) are connected to form a unit axially displaceable relative to said piston guide.

* * * * *